US011154122B2

(12) United States Patent
Collie

(10) Patent No.: US 11,154,122 B2
(45) Date of Patent: Oct. 26, 2021

(54) FLEXIBLE INSULATIVE CONTAINER WITH VALVE

(71) Applicant: James E. Collie, St. Augustine, FL (US)

(72) Inventor: James E. Collie, St. Augustine, FL (US)

(73) Assignee: ICEMULE COMPANY, INC., St. Augustine, FL (US)

( * ) Notice: Subject to any disclaimer, the term of this patent is extended or adjusted under 35 U.S.C. 154(b) by 525 days.

(21) Appl. No.: 15/019,996

(22) Filed: Feb. 10, 2016

(65) Prior Publication Data

US 2017/0225872 A1 Aug. 10, 2017

(51) Int. Cl.

| | |
|---|---|
| ***B65D 81/38*** | (2006.01) |
| ***F16K 15/20*** | (2006.01) |
| ***A45C 3/00*** | (2006.01) |
| ***A45C 11/20*** | (2006.01) |
| ***A45F 3/04*** | (2006.01) |
| ***A45F 3/02*** | (2006.01) |
| ***A45C 7/00*** | (2006.01) |
| ***A45C 11/22*** | (2006.01) |
| ***B65D 33/30*** | (2006.01) |

(52) U.S. Cl.

CPC ..... *A45C 3/001* (2013.01); *A45C 7/0081* (2013.01); *A45C 11/20* (2013.01); *A45C 11/22* (2013.01); *A45F 3/02* (2013.01); *A45F 3/04* (2013.01); *B65D 33/30* (2013.01); *B65D 81/3897* (2013.01); *A45F 2003/025* (2013.01)

(58) Field of Classification Search

CPC ..... B65D 88/16; B65D 88/1606; B65D 88/1612; B65D 88/1618; B65D 88/1625; B65D 88/1631; B65D 88/1637; B65D 88/1643; B65D 88/165; B65D 88/1656; B65D 88/1662; B65D 88/1668; B65D 88/1675; B65D 88/1681; B65D 88/1687; B65D 88/1693; B65D 88/18; B65D 88/20; B65D 88/22; B65D 88/24; B65D 81/3897; A45C 11/20; A45C 13/36; A45C 3/001; A45C 7/0081; A45C 11/22; F16K 31/50; F16K 31/504; F16K 1/02; F16K 1/04; F16K 15/50

USPC ..... 383/17–20, 3, 100–103, 88–91, 105, 383/107–110, 112–114, 119; 5/413 AM, 5/681, 706, 708, 710, 713, 655.3; 251/264, 266, 267, 273; 137/232, 233, 137/234, 223

See application file for complete search history.

(56) References Cited

U.S. PATENT DOCUMENTS 2,772,692 A 12/1956 Russell
3,785,395 A * 1/1974 Andreasson ..... F16K 15/20 137/223
4,127,155 A * 11/1978 Hydorn ..... A45C 13/02 383/106

(Continued)

*Primary Examiner* — Jes F Pascua
*Assistant Examiner* — Nina K Attel
(74) *Attorney, Agent, or Firm* — Thomas I Horstemeyer, LLP

(57) ABSTRACT

The present disclosure relates to a high-performance, portable, flexible, collapsible, inflatable, insulative container with increased carrying capacity and the portability of a backpack. The container of the present disclosure is both collapsible as well as inflatable via the use of a non-leaking, substantially waterproof valve that facilitates air flow into and out of an insulative space of the container.

20 Claims, 7 Drawing Sheets

(56) References Cited

U.S. PATENT DOCUMENTS

| | | | | |
|---|---|---|---|---|
| 4,262,801 | A * | 4/1981 | Avery | B65D 81/075 206/522 |
| 4,529,167 | A | 7/1985 | Harrison et al. | |
| 5,415,614 | A * | 5/1995 | Nattrass | B65D 88/1612 493/226 |
| 5,931,583 | A * | 8/1999 | Collie | A45C 11/20 383/110 |
| 2005/0056314 | A1 | 3/2005 | Lin | |
| 2007/0053617 | A1* | 3/2007 | Naidu | B65D 75/5877 383/66 |
| 2008/0156376 | A1 | 7/2008 | Lin | |
| 2009/0282617 | A1* | 11/2009 | Abbate | F16K 1/04 5/630 |
| 2013/0105040 | A1* | 5/2013 | Langston | F16K 15/20 141/3 |
| 2014/0248003 | A1* | 9/2014 | Mogil | A45C 3/001 383/3 |
| 2014/0254956 | A1* | 9/2014 | Buell, III | B65D 33/00 383/64 |

* cited by examiner

FLEXIBLE INSULATIVE CONTAINER WITH VALVE

BACKGROUND

Maintaining the temperature of items whose temperatures differ from their environment has always been a challenge. Thermal insulation containers, commonly referred to as "coolers," are frequently used when one cannot use refrigeration units and wishes to keep items cooler than surrounding temperatures. Conventional coolers are commonly made from insulated hard plastic containers having either hinged or fully removable lids. These coolers are typically large, heavy, and bulky. Additionally, although often waterproof, and therefore useable with ice, conventional coolers are rigid and heavy, rendering them undesirable for transporting or using while engaging in outdoor activities such as biking, hiking, rafting, or kayaking. The interior storage areas of conventional coolers can also be difficult to clean before and after use and are further difficult to dry after use.

In an effort to overcome these drawbacks of conventional coolers, some manufacturers have produced soft coolers. While these soft coolers are pliable and lighter than their conventional predecessors, they typically are not waterproof and are therefore designed to be used with ice substitutes, which is not the preferred cooling medium. In addition, typical soft coolers are generally not made of durable materials and construction, and as a result, they fall apart easily under stress. Moreover, most soft coolers are sewn together and/or have zippers, which means they are not waterproof and cannot carry ice without leakage.

In addition to these drawbacks, neither hard nor soft coolers can be carried comfortably and securely during outdoor activities, such as hiking. Typically, soft coolers have short handles or purse-like straps and are not meant to be carried long distances. Hard coolers are too heavy and bulky to be carried comfortably for long distances or for extended periods of time.

Yet another drawback of both hard and soft coolers is that they cannot be compactly rolled up for storage when not in use, thus, limiting their usefulness for certain outdoor sports and activities, as well as travel. Soft coolers tend to be more compact than hard coolers. However, soft coolers typically consist of insulating material within two layers. There is a certain amount of air that exists between these layers, thus, if a user attempts to compactly roll up or fold the soft cooler, a balloon effect is created.

To overcome this drawback, an opening has been used in the outer layer of soft coolers as a way to release the air between the layers. However, this opening exposes the insulation layer housed between the two layers to moisture, which can ruin the insulation. Another solution has been to use a pull tab valve (e.g., similar to those used on pool flotation devices) to release the air between the two layers, yet protect the insulation layer from moisture when the valve is closed. However, this type of valve is easily, accidentally opened, thus, again exposing the insulation layer to moisture and damage.

SUMMARY

Embodiments of the present disclosure, in one aspect, relate to a flexible, insulative container with valve. More particularly, embodiments of the present disclosure relate to a portable, high-capacity cooler that can be rolled up or folded for storage with the use of a water-tight valve.

Briefly described, embodiments of the present disclosure include a pliable, collapsible, inflatable, thermally insulative, substantially waterproof container for maintaining the temperature of articles stored therein, comprising a body portion having a top end, a bottom end, a flexible, waterproof interior liner, and a flexible, waterproof exterior shell, where the interior liner and the exterior shell are sealed together at the top end of the body portion forming an interior insulative space therebetween and a storage space that is lined by the interior liner and having an opening at the top end of the body portion, a waterproof base, flexible insulative material disposed within the interior insulative space and being sealed therein, a roll down quick release closure fixed to the body portion at the top end for closing the opening and the storage space, and at least one valve disposed within the exterior shell by way of a fluid impervious seal and configured to control air flow into and out of the insulative, interior space between the interior liner and the exterior shell.

Embodiments of the present disclosure also include a pliable, collapsible, inflatable, thermally insulative, substantially waterproof container for maintaining the temperature of articles stored therein, comprising a body portion having a top end, a bottom end, a flexible, waterproof interior liner, and a flexible, waterproof exterior shell, where the interior liner and the exterior shell are sealed together at the top end of the body portion forming an interior insulative space therebetween and a storage space that is lined by the interior liner and having an opening at the top end of the body portion, a waterproof base, flexible insulative material disposed within the interior insulative space and being sealed therein, a roll down quick release closure fixed to the body portion at the top end for closing the opening and the storage space, at least one valve disposed within the exterior shell by way of a fluid impervious seal and configured to control air flow into and out of the insulative, interior space between the interior liner and the exterior shell, at least one seam below the opening at the top end of the body portion, and at least one weld line below the at least one seam.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 2:
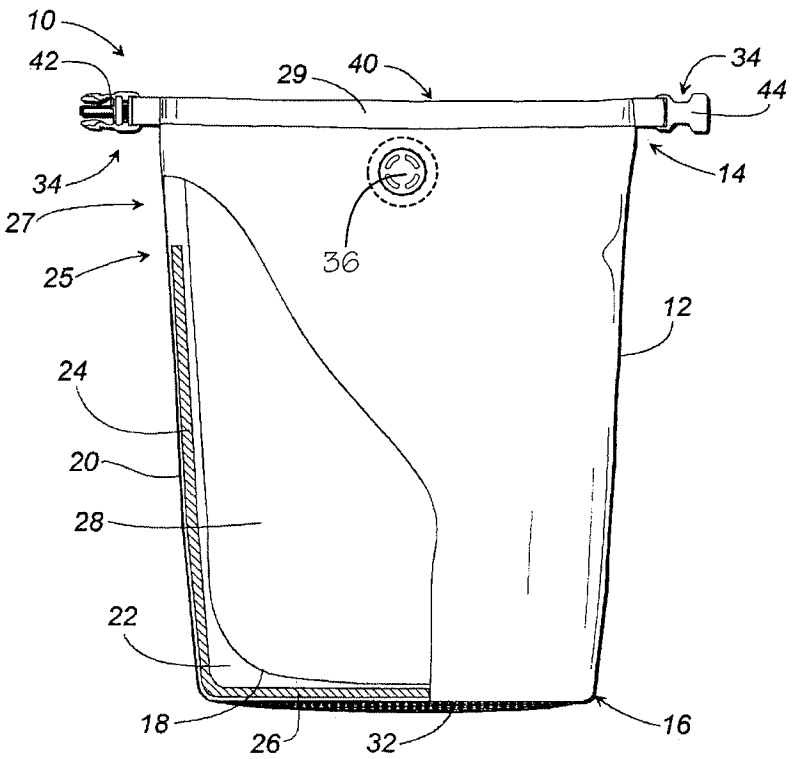
FIG. 2 illustrates a side partial cut-away view of an embodiment of the flexible insulative container with valve of the present disclosure.

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. While the stated range includes one or both of the limits, ranges excluding either or both of those included limits are also included in the disclosure.

Unless defined otherwise, all technical terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure.

It must be noted that, as used in the specification and the appended claims, the singular forms "a," "an," and "the" include plural referents unless the context clearly dictates otherwise. Thus, for example, reference to "a support" includes a plurality of supports.

DISCUSSION

The present disclosure relates to a high-performance, portable, flexible, collapsible, inflatable, insulative container with increased carrying capacity and the portability of a backpack. The container of the present disclosure is both collapsible (e.g., can be rolled up for storage) as well as inflatable (e.g., can be inflated to increase cooling capacity and/or provide further cushion to contents of the container and can float) via the use of a non-leaking, substantially waterproof valve that facilitates air flow into and out of an insulative space of the container. The container of the present disclosure includes a pliable, collapsible, inflatable, thermally insulative cooler for maintaining the temperature of the contents inside the cooler (e.g., food and beverages), which facilitates the use of ice as a cooling medium.

Embodiments of the present disclosure include a pliable, thermally insulative container with enhanced carrying capacity as well as the ability to be collapsed and rolled or folded for easy storage when not in use (e.g., can be rolled or folded to less than about one-fifth of its in-use height, less than about one-fourth of its in-use height, less than about one-third of its in-use height). The present disclosure provides for a cooler that has the portability of a backpack as well as the performance of a hard cooler. The container of the present disclosure is not sewn together and has no zippers. As a result, the container of the present disclosure can carry ice without leaking.

The container of the present disclosure essentially comprises a body portion defined by a top end and a bottom end. The body portion is formed of a flexible, waterproof interior liner and a flexible, waterproof exterior shell. The interior liner is substantially bag shaped and forms a storage space having an opening at a top end of the body portion. The interior liner and exterior shell are sealed together at the top end of the body portion such that the bag shaped interior liner hangs downwardly from the top end, creating an insulative, interior space between the interior liner and the exterior liner. Disposed within this interior space is a flexible insulative material. In an embodiment of the present disclosure, the flexible insulative material extends from the bottom end of the body portion to a point adjacent to the top end, leaving an uninsulated region at the top end of the container which facilitates closure. The container of the present disclosure is flexible such that it is deformable. The container can be easily stuffed into a conventional backpack for use or rolled or folded for storage in minimum space.

In an embodiment of the present disclosure, the container includes at least one carrying strap (e.g., reinforced straps). In an embodiment, the container includes reinforced back straps as well as back pads so that the container can be easily and comfortably carried by a user for extended periods of time. In another embodiment, the container includes padded carrying straps, at least one tie down clip, and/or bungee webbing. In an embodiment, the bungee webbing is used for attaching gear and/or a paddle.

In accordance with another aspect of the present disclosure, the container includes a waterproof base. In an embodiment, the waterproof base is sealed to the exterior shell at the bottom end of the body portion, closing the interior insulative space. In a preferred embodiment, the container includes a fastener at the top end of the body portion for closing the opening of the storage space. Preferably, the fastener comprises a quick-release coupler having an insertion member and an engaging member being attached to a band such that the insertion and engaging members oppose each other. The band is preferably attached to the body portion at the top end.

In use, ice and objects to be cooled are placed in the storage space through the opening at the top end of the container. Once all the ice and objects desired to be kept cool are placed in the storage space, the opening to the storage space is closed. To do so, the insertion member and the engaging member are first pulled in opposite directions drawing the band taut, closing the opening. Then, the taut band is rolled down, toward the bottom end, over itself, the outer shell, and interior liner, at least twice. After rolling, the insertion member of the quick-release coupler is inserted into the engaging member, fixing the rolled down portion in position. Once closed with the contents inside, the container can be placed in a conventional backpack to be easily transported. After use, the interior liner can be pulled out of the opening of the storage space to quickly and easily clean and dry the interior storage space.

In accordance with another aspect of the present disclosure, the container includes a valve (e.g., air valve) disposed within the exterior shell. The valve is welded to the exterior shell with a fluid impervious sealing arrangement so that it creates a route for air to flow in to and out of the interior insulative space. The valve, when in an open position, creates a channel for and allows air to enter or exit the insulative, interior space between the interior liner and the exterior shell. In one embodiment, the valve allows a user to regulate the amount of air that flows into or out of the space between the interior lining and the exterior shell. The valve provides for modulation, which allows the user to alter or adapt the container depending on the circumstances. The valve of the present disclosure is configured so that it is not easily accidentally opened. As a result, water is prevented from entering the interior space between the interior liner and exterior shell. In an embodiment, the valve of the present disclosure requires user operation.

In an embodiment, the air valve allows for insulation layer air removal so the container can be rolled up for storage. In an embodiment, a user opens the valve to allow air to leave the insulation layer so that the container can be rolled and/or folded for compact storage. In another embodiment, the user manually pushes air out of the insulative space by pressing on the container while the air valve is in the open position.

In another embodiment, a user opens the valve to allow air to enter the insulation layer and thereby inflate the container. In an embodiment, the valve is opened by turning the valve in a counter-clockwise direction. A user then blows air in to the valve to inflate the cooler to the desired amount.

In an embodiment, the inflated container has more insulating capability. In another embodiment, the inflated container protects the contents of the container by the increased cushion created when the container is inflated. In another embodiment, the inflated container is buoyant and can float.

In one embodiment of the present disclosure, the valve comprises a twist valve configured to be non-leaking (water tight) so that water cannot get in between the two layers (interior liner and exterior shell) and ruin the insulating material. The twist valve diminishes the chance of unintentional opening because it necessitates a user to open and close it. In an embodiment, the valve serves at least two functions: it allows a user to remove air in the insulation layer so that the container can be compressed and rolled up for storage, and it allows a user to add air to the container to hold its shape, provide more insulating value in addition to the foam insulation, and protect the contents of the container.

Figure 1:
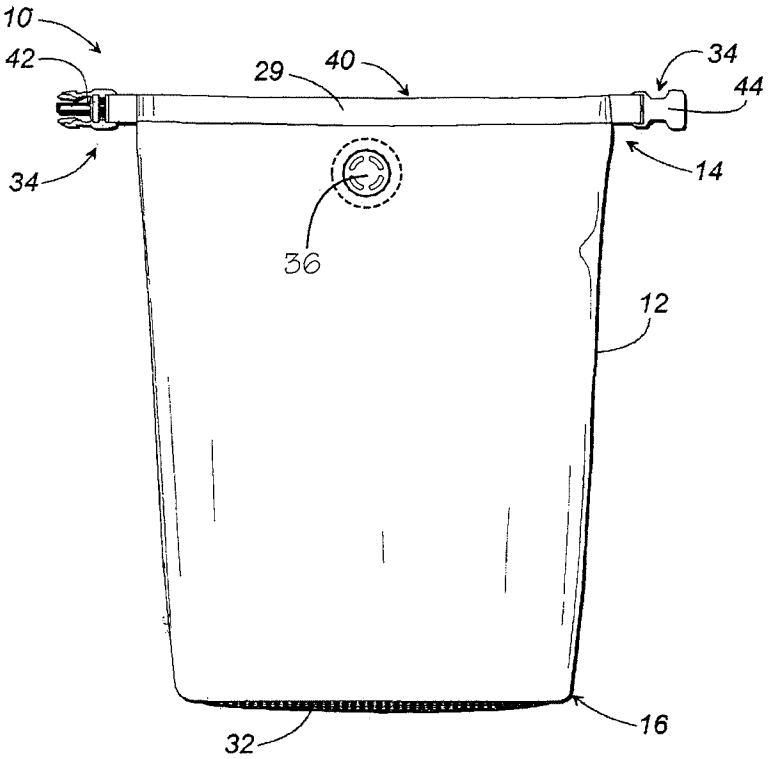
FIG. 1 illustrates a side view of an embodiment of the flexible insulative container with valve of the present disclosure.

Another embodiment of the container of the present disclosure is a container that comprises increased carrying capacity. In an embodiment, the band comprises single, double, or triple sewn seams to provide strength so that the container will not rip or tear if it is picked up without rolling the top end over and shutting the container. In an embodiment, the band includes single, double, or triple sewn seams to increase the amount of weight the container can carry without stretching or tearing. In another embodiment, a radio frequency weld is below the sewing line so that no water can penetrate the interior shell of the container where the foam insulation is housed. In an embodiment, the stitching (e.g., single, double, triple, etc.) allows for a stress weight capacity of up to about 65 pounds (e.g., up to about 25 pounds, up to about 30 pounds, up to about 35 pounds, up to about 40 pounds, up to about 45 pounds, up to about 50 pounds, up to about 55 pounds, up to about 60 pounds, up to about 65 pounds), FIGS. 1 through 10 illustrate the pliable, collapsible, inflatable, thermally insulative container 10 with increased carrying capacity of the present disclosure. Referring to FIGS. 1 and 2, the container 10 is preferably cylindrical and includes a body portion 12 which has a top end 14 and bottom end 16. The body portion 12 is constructed of a flexible, waterproof interior liner 18 and a flexible, waterproof exterior shell 20. The container 10 is preferably constructed of materials deformable in shape, thereby making the container 10 easily stuffed into a secondary carrying apparatus, such as a conventional backpack or the storage area of a kayak, for transportation or rolled or folded for storage. The use of the air valve 36 allows for the container to be compressed flat by allowing all of the air between the two layers to be released so that the container can be rolled or folded for storage.

In a preferred embodiment, the waterproof interior liner 18 comprises PVC with a weldable film that is compliant with the Consumer Product Safety standard for restrictions of Phthalates in childrens toys (commonly known as the 6P standard). The waterproof exterior shell 20 comprises vinyl. Although described herein as being formed of particular materials, it will be understood that the interior liner 18 and the exterior shell 20 can be made of other suitable materials, for example, nylon and/or Polyester with a thermoplastic polyurethan (TPU) film for welding.

Figure 3:
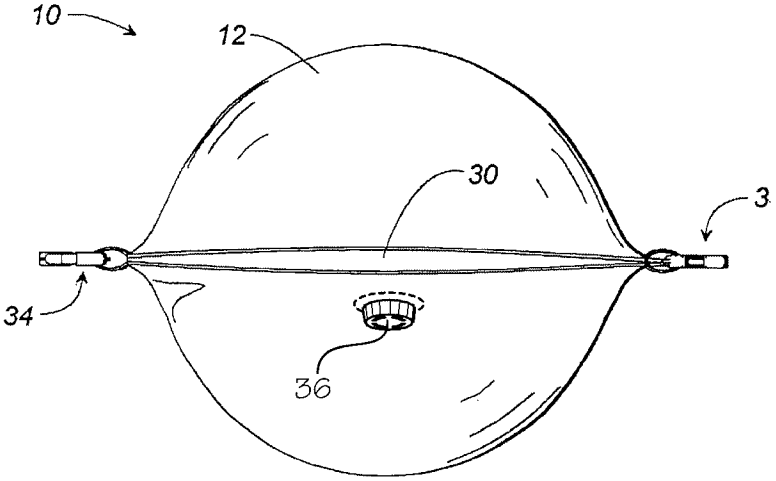
FIG. 3 illustrates a top view of an embodiment of the flexible insulative container with valve of the present disclosure.

In a preferred embodiment, the interior liner 18 and the exterior shell 20 are sealed together at the top end 14 of the body portion 12, creating an insulative interior space 22 therebetween and an interior storage space 28, which is lined by the interior liner 18. As shown in FIG. 2, the interior liner 18 is preferably substantially bag shaped such that the interior liner 18 hangs downwardly from the top end 14 of the container 10 toward the bottom end 16 of the container 10. As will be described below, this bag shape facilitates cleaning of the storage space 28 of the container 10. When the container is in use, the interior storage space 28 holds the contents of the container, including the cooling medium and the objects to be cooled. The exterior shell 20 is closed at the bottom end 16 of the body portion 12 enclosing the insulative interior space 22. As shown in FIG. 3, the container 10 has an opening 30 at the top end 14 of the body portion 12 which provides access to the interior storage space 28.

Figure 4:
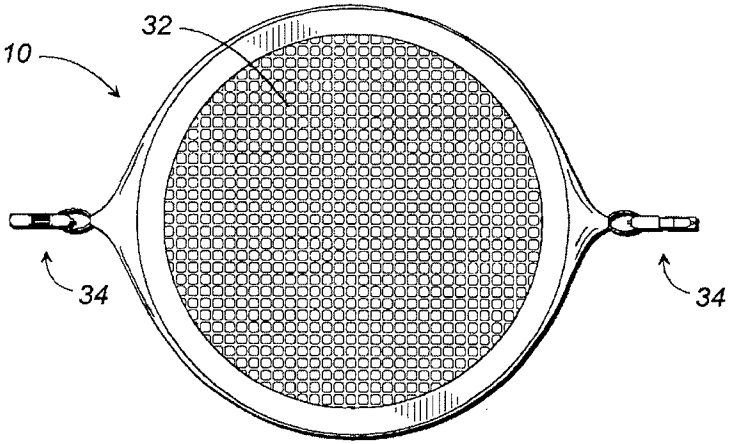
FIG. 4 illustrates a bottom view of an embodiment of the flexible insulative container with valve of the present disclosure.
Figure 6:
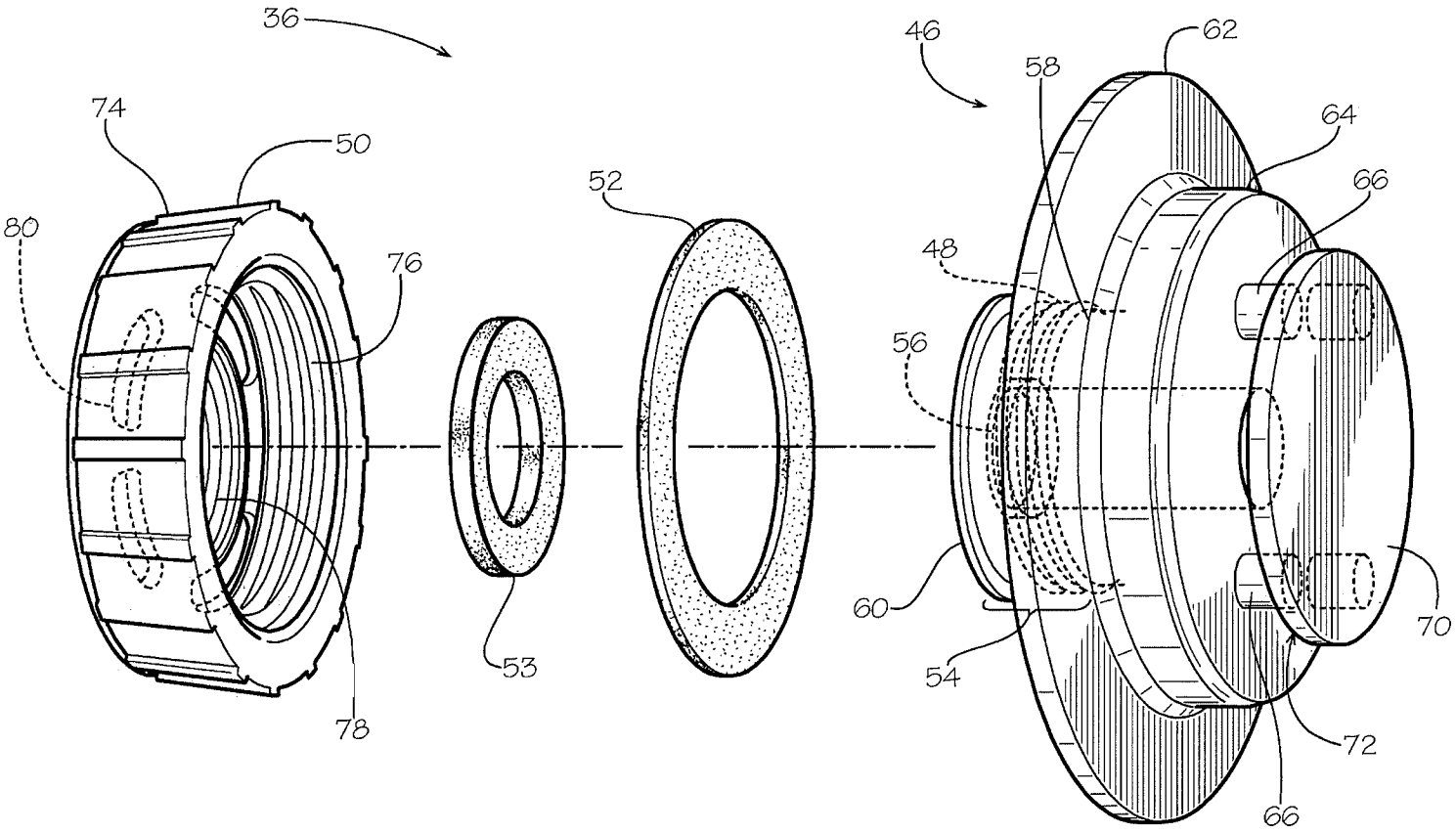
FIG. 6 illustrates an exploded view of an embodiment of the valve of the present disclosure.

In a preferred embodiment, the flexible insulative container 10 has a waterproof base 32 that is sealed to the exterior shell 20 at the bottom end 16 of the body portion 12, as shown in FIG. 4, and the base 32 is substantially circular in shape. Moreover, the base 32 is substantially planar so that the container 10 can stand upright when placed on a level, flat surface.

Within the interior insulative space 22, flexible insulative material, preferably in the form of a side insulative portion 24 and a bottom insulative portion 26, is placed. Typically, the bottom insulative portion 26 comprises a polyurethane foam disc that is placed between the waterproof base 32 and the interior liner 18. Preferably, the bottom insulative portion 26 is fixed to the waterproof base 32. The side insulative portion 24 typically comprises a rectangular piece of polyurethane foam that is placed between the exterior shell 20 and the interior liner 18 and extends from the bottom end 16 of the body portion 12 to a point 25 adjacent the top end 14 of the body portion 12, leaving an uninsulated region 27 at the top end 14. The uninsulated region 27 facilitates closure of the opening 30. The side insulative portion 24 is preferably fixed to the exterior shell 20. It will be understood that the insulative portions 24 and 26, although described and illustrated as separate pieces and fixedly disposed inside the insulative space 22, could instead be formed of one single piece or be disposed in an unfixed fashion. Furthermore, although polyurethane foam is preferred for the insulative material, a person of ordinary skill in the art will appreciate that the insulative material may comprise one or more other materials.

A fastener 40 is attached to the top end 14 of the body portion 12 for closing the opening 30 of the interior storage space 28. In a preferred embodiment, the fastener 40 comprises a band 29 and a quick-release coupling 34 that comprises an insertion member 42 and an engaging member 44. The insertion member 42 and the engaging member 44 are fixed to the band 29 such that the insertion member 42 and the engaging member 44 are positioned at opposite ends of the top of the container as depicted in FIG. 1. Although the fastener 40 is disclosed as comprising a band 29 and a quick-release coupling 34, it should be appreciated that closure can be accomplished by other means, such as with a channel-lock fastening system, a hook and loop system, or the like. So described, the embodiment shown in FIGS. 1 and 2 requires a relatively quick and inexpensive construction process having few steps. Additionally, the construction provides for a substantially waterproof interior storage space 28 allowing ice to be employed as a cooling medium.

To make the tasks of cleaning and drying the interior storage space 28 quick and simple, the interior liner 18 is pulled out of the opening 30 at the top end 14 of the container 10. The interior liner 18 remains sealed to the exterior shell 20 at the top end 14, and the interior liner 18 of the container 10 is effectively turned in-side-out. Since the flexible, insulative material 24 and 26 is preferably fixedly attached to the exterior liner 20 and the waterproof base 32, respectively, the insulative material 24 and 26 remains in place when the interior liner 18 is pulled out of the opening 30.

Figure 5:
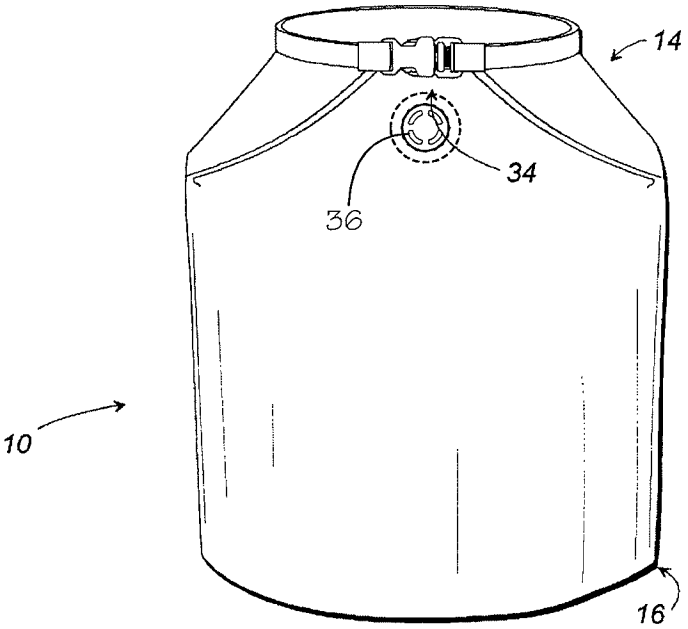
FIG. 5 illustrates a top, side perspective view of an embodiment of the flexible insulative container with valve as closed using a quick-release coupler.

In use, the opening 30 of the container 10 of the present invention is closed by pulling the insertion member 42 and the engaging member 44 away from each other, thereby drawing the band 29 taut. After pulling the band 29 taut in this manner, the band 29 is rolled downward over itself, the interior liner 18, and the exterior shell 20, towards the bottom end 16. Not including insulative material, the uninsulated region 27 is less bulky and therefore facilitates rolling of the band. After the band 29 is rolled twice, the insertion member 42 is inserted into the engaging member 44 with the engaging member 44 resiliently engaging the insertion member 42 to fix the rolled band 29, interior liner 18, and exterior shell 20 in place and the opening 30 fixedly closed as illustrated in FIG. 5. It should be noted that the opening 30 of the container 10 may be closed using other methods, such as by rolling the taut band 29 down the body portion 12 two or more times.

In an embodiment, the flexible insulative container 10 includes an air valve 36. It is to be understand that any suitable water-tight valve that cannot be unintentionally opened (e.g., a user must open the valve) can be used with the container of the present disclosure. For example, any marine type valve used with inflatables may be used in the container of the present disclosure. It should further be noted that, although the figures illustrate placement of the valve on the container of the present disclosure, one skilled in the art would understand that there are numerous possibilities for placement of the valve, as long as it serves its intended function. Thus, the figures merely illustrate one embodiment for placement of the air valve.

In one embodiment, the valve 36 (FIG. 6) comprises a body 46 with a threaded portion 48 on which is mounted a rotating member screw cap 50. Optionally, the valve 36 comprises a washer 52 between the body 46 and cap 50 to ensure a tight seal when the valve is in a closed position. The washer 52 can be made of rubber or other suitable material. The washer 52 provides for a tight seal between the body 46 and the cap 50 to help prevent water from getting into the valve and subsequently into the interior space between the lining and the shell. In another embodiment, a additional washer 53 may be used to further ensure a tight seal. This additional washer 53 may be situated at the outside of the top end 56 of the shaft 54 towards the cap portion.

In an embodiment, the body 46 of the valve 36 comprises a cylindrical, hollow shaft 54 with a top end 56 and a bottom end 58. The bottom end 58 of the shaft 54 is threaded (e.g, the bottom half of the shaft is threaded, the bottom third of the shaft is threaded, the bottom quarter of the shaft is threaded). The top end 56 of the shaft 54 comprises a shoulder 60 (e.g., a slight shoulder). The shoulder 60 allows the cap 50 to be secured onto the shaft 54 (e.g., the cap snaps onto the shoulder of the shaft). Once the cap 50 is secured onto the shoulder 60 of the shaft 54, it can be rotated on the threaded portion of the shaft 54 to either an open position or a closed position (due to the interior wall of the cylindrical portion of the cap being threaded as well). It is to be understood, however, that a valve with a removal cap or a valve with a cap attached to the body of the valve via a lanyard can also be used.

In an embodiment, the optional washer 52 is positioned at the bottom end 58 of the shaft 54 so that when the cap 50 is rotated down the shaft 54 so that the valve 36 is in the closed position, a water-tight seal is accomplished. In another embodiment, after the container 10 is compressed and rolled up, the valve 36 is closed to ensure that no water gets in to the insulation space.

Below the threading on the bottom end 58 of the shaft 54, the valve 36 comprises a first lower shoulder 62 and a second lower shoulder 64, the first lower shoulder 62 having a larger diameter than the second lower shoulder 64. The first lower shoulder serves to secure the valve 36 in the exterior shell 20 via a welded seam. In an embodiment, the second lower shoulder 64 has a thickness greater than that of the first lower shoulder 62.

In an embodiment, a plurality of cylindrical pieces 66 extend from a bottom surface 68 of the second lower shoulder 64. The plurality of cylindrical pieces 66 are evenly spaced and do not touch. A disc piece 70 is attached to the plurality of cylindrical pieces 66 so that the disc piece 70 is parallel to the second lower shoulder 64. The spacing of the cylindrical pieces 66 allows for a space 72 to be created between the disc piece 70 and the second lower shoulder 64. This space 72 allows for air to flow from the insulative space 22 and into the shaft 54 of the valve 36. If the valve 36 is in the open position, the air will continue to travel up the shaft 54 and out of the valve. The reverse is also true.

The cap portion 50 of the valve 36 comprises a hollow cylindrical body 74 with threading on the interior portion 76 of the cylindrical body 74 and a disc portion 78 on one end of the hollow cylindrical body 74. The disc portion 78 comprises at least one aperture 80 which allows for air to flow into or out of the shaft portion 54 of the valve 36 when the valve is in the open position. The connection between the shaft 54 and the cap 50 is similar to a nut and bolt type of connection.

Figure 10:
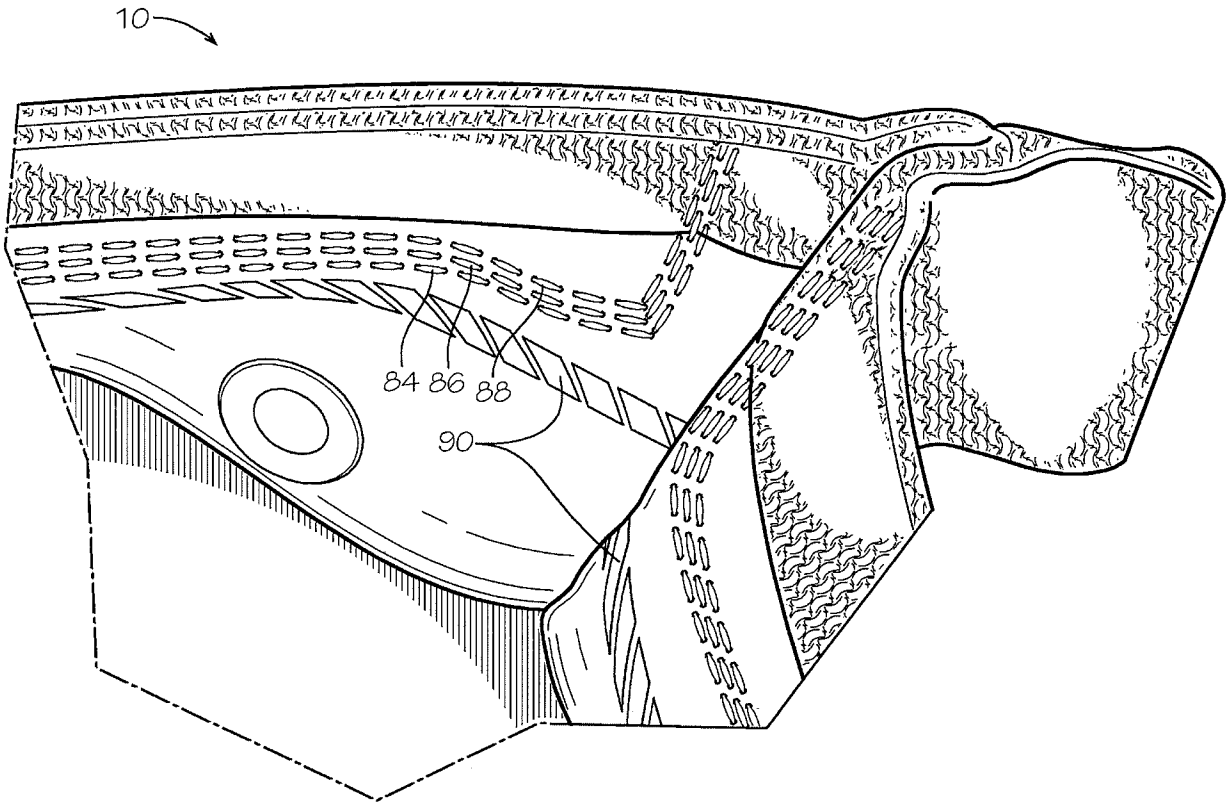
FIG. 10 illustrates an embodiment of the insulative container with valve of the present disclosure with at least one seam below the opening of the container and at least one weld line below the seam(s).

Another embodiment of the present disclosure includes a container with increased carrying capacity. This is accomplished through a sewing line 82 which comprises single 84, double 86, and/or triple 88 sewn seams at the top end 14 of the container 10 (FIG. 10). Below the sewing line 82, the container 10 further comprises a radio frequency weld 90. The radio frequency welding 90 provides an air and water tight seal that cannot be accomplished with sewing. The welding provides support to the sewn seams that, when stressed, the thread takes the pressure and could break. The radio frequency welding 90 distributes any stress, allowing for increased carrying capacity of the container 10 while preventing any air, moisture, or debris from getting in to the container and/or the insulative space.

Figure 7B:
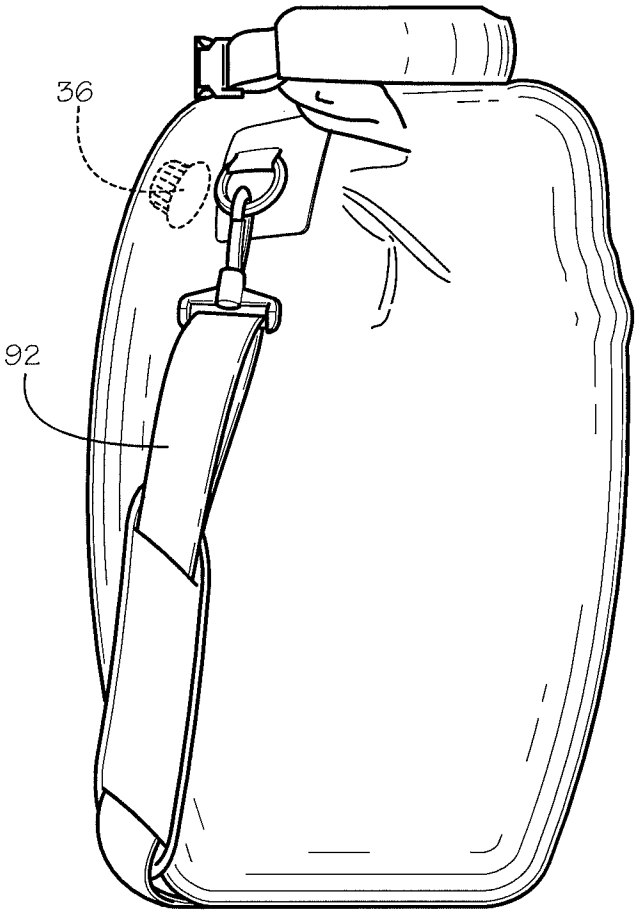
FIGS. 7A-7B illustrate an embodiment of the flexible insulative container with valve of the present disclosure which includes a reinforced carrying strap.
Figure 7A:
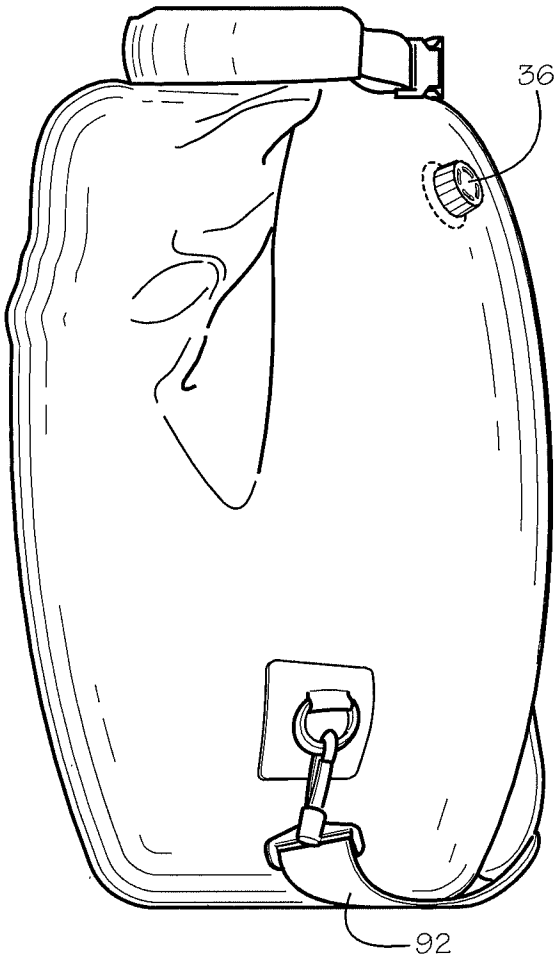
Figure 8B:
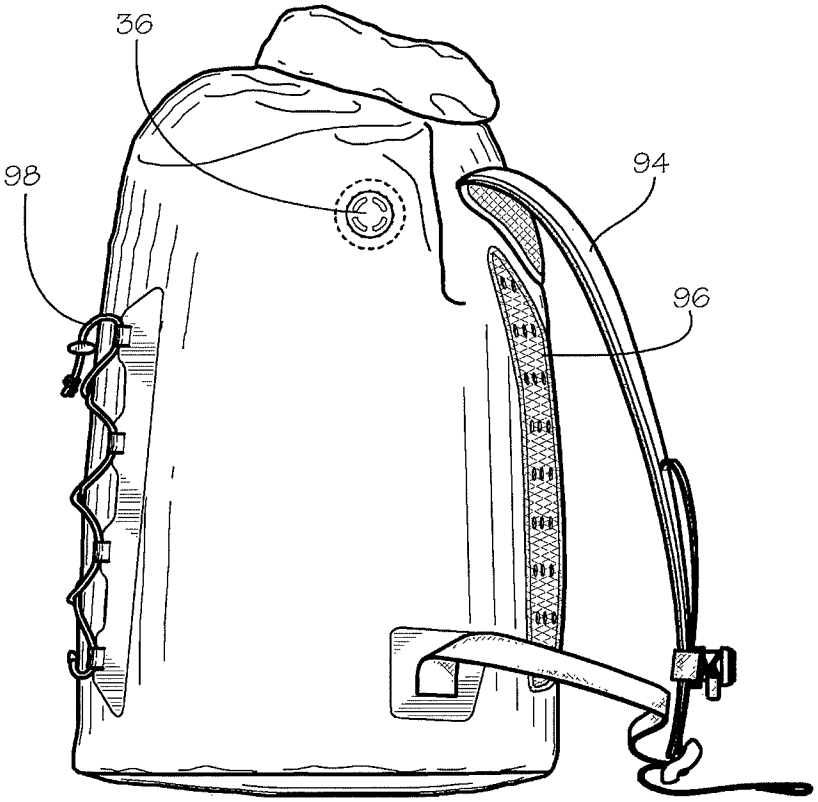
FIGS. 8A-8B illustrate an embodiment of the insulative container with valve of the present disclosure which includes reinforced carrying straps and ventilated back pads.
Figure 8A:
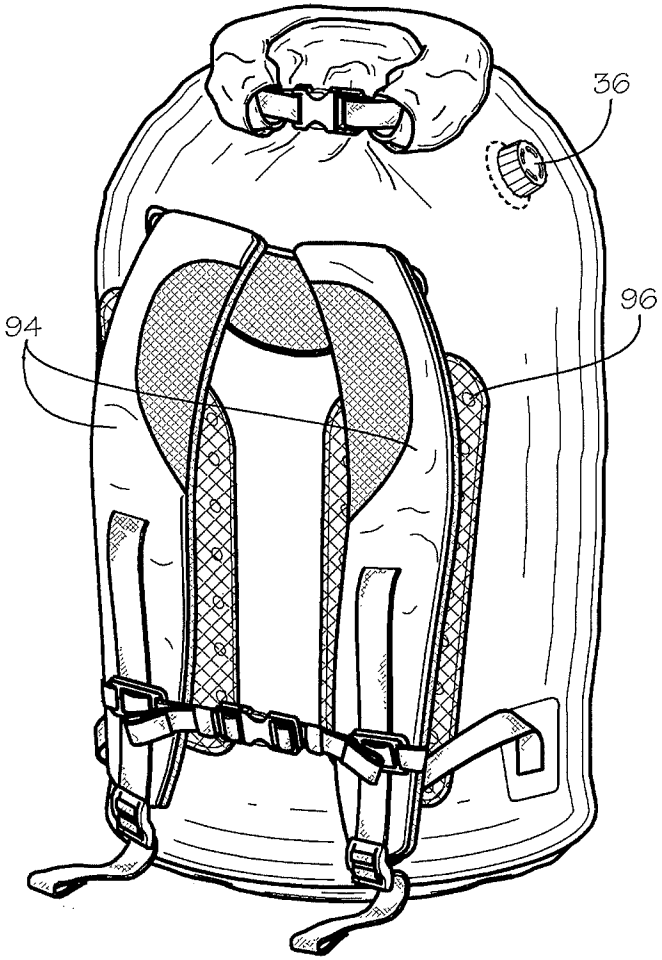
Figures 9A, 9B, 9C:
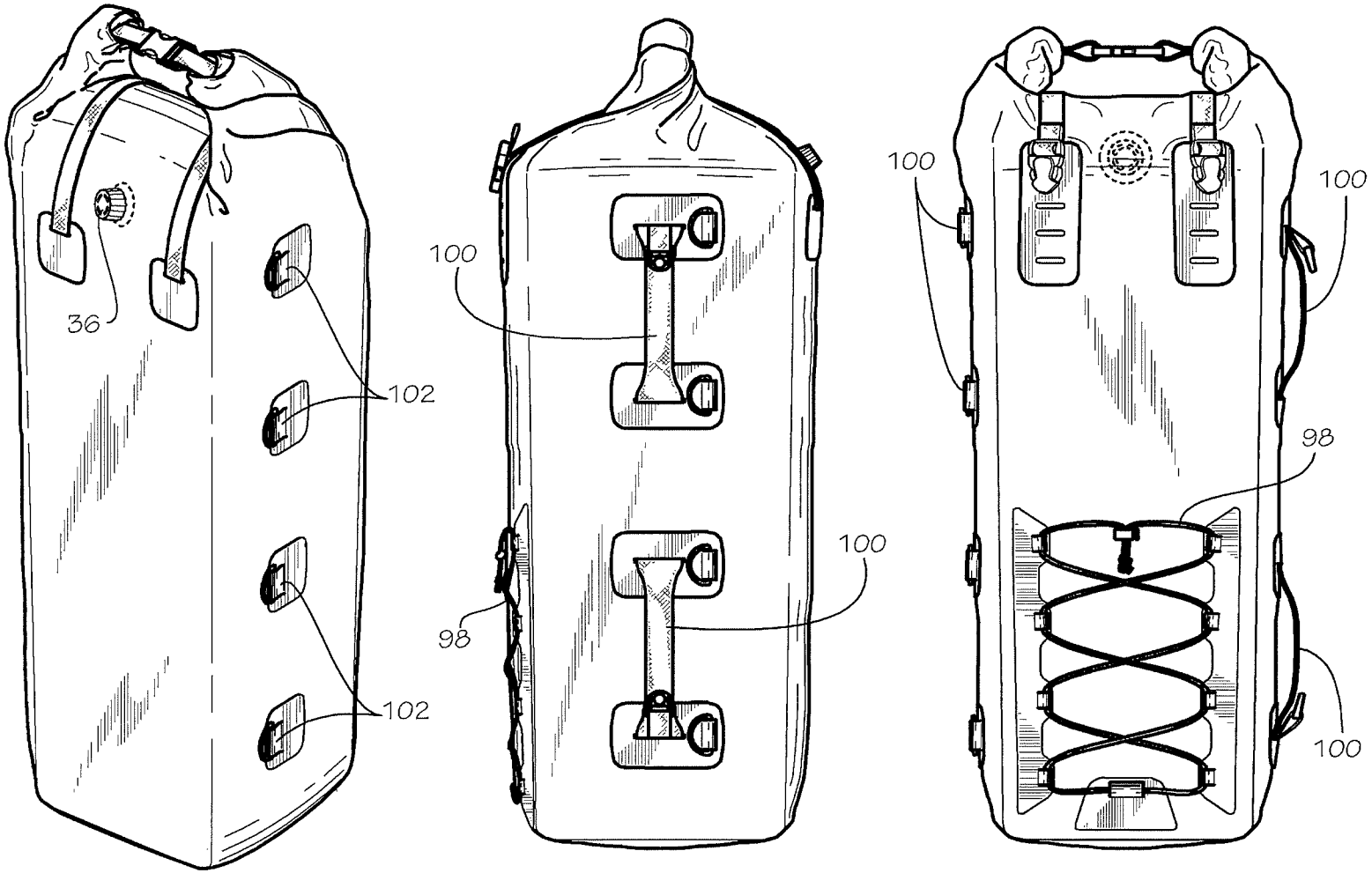
FIGS. 9A-9C illustrate an embodiment of the insulative container with valve of the present disclosure which includes padded carrying straps, multiple tie down clips, and bungee webbing.

In another embodiment of the invention, the container 10 further comprises a reinforced carrying strap 92 (FIGS. 7A and 7B). In an embodiment, the container 10 further comprises a plurality of reinforced carrying straps 94 and/or at least one ventilated back pad 96 and/or bungee webbing 98 (FIGS. 8A-8B). Finally, in another embodiment, the container 10 of the present disclosure further comprises at least one padded carrying strap 100, and/or a plurality of tie down clips 102, and/or bungee webbing 98 (FIGS. 9A-9C).

It should be emphasized that the above-described embodiments of the present disclosure are merely possible examples of implementations, and are merely set forth for a clear understanding of the principles of the disclosure. Many variations and modifications may be made to the above-described embodiments. All such modifications and variations are intended to be included herein within the scope of this disclosure and protected by the following claims.

Therefore, at least the following is claimed:

1. A pliable, collapsible, inflatable, thermally insulative container, comprising:

a body portion having a top end, a bottom end, a flexible, waterproof interior liner, and a flexible, waterproof exterior shell, wherein the interior liner and the exterior shell are sealed together at the top end of the body portion forming an interior insulative space therebetween and a storage space that is lined by the interior liner and having an opening at the top end of the body portion;

a flexible insulative material disposed within the interior insulative space and being sealed therein;

a roll down quick release closure fixed to the body portion at the top end for closing the opening and the storage space;

at least one manually operated twist valve disposed through and secured to the exterior shell by a welded seam to control air flow into and out of the interior insulative space between the interior liner and the exterior shell;

wherein the container is substantially waterproof;

wherein the twist valve comprises a body and a cap, the cap comprising at least one aperture and configured to be manually rotatable relative to the body, the body comprising at least one air shaft, a first shoulder welded to the exterior shell, a second shoulder within which the air shaft opens into the interior insulative space, and a disc piece spaced apart from the second shoulder to create a clearance between the air shaft and the flexible insulative material;

wherein the twist valve comprises a substantially air and water tight seal when the cap is manually rotated relative to the body in a first rotational direction to a closed position where the at least one aperture is obstructed; and wherein the twist valve is configured to allow air flow into the interior insulative space between the waterproof exterior shell and the waterproof interior liner to inflate the container and protect and insulate any article stored therein when the cap is manually rotated relative to the body in a second rotational direction to an open position where the at least one aperture is unobstructed.

2. The container of claim 1, wherein the cap is secured to the body and wherein when the valve is in the open position, the cap remains secured to the body.

3. The container of claim 1, wherein a waterproof base is sealed to the exterior shell at the bottom end of the body portion thereby enclosing the interior insulative space.

4. The container of claim 1, wherein the cap and the body of the valve each comprise threads, wherein the cap threads engage the body threads, and wherein the cap can be moved relative to the body pursuant to the threads.

5. A pliable, collapsible, inflatable, thermally insulative container, comprising:

a body portion having a top end, a bottom end, a flexible, waterproof interior liner, and a flexible, waterproof exterior shell, wherein the interior liner and the exterior shell are sealed together at the top end of the body portion forming an interior insulative space therebetween and a storage space that is lined by the interior liner and having an opening at the top end of the body portion;

a flexible insulative material disposed within the interior insulative space and being sealed therein;

at least one manually operated twist valve disposed through and secured to the exterior shell by way of a fluid impervious seal and configured to control air flow into and out of the interior insulative space between the interior liner and the exterior shell;

wherein the twist valve comprises a body and a cap, the cap comprising at least one aperture and configured to be manually rotatable relative to the body, the body comprising at least one air shaft, a first shoulder welded to the exterior shell, a second shoulder within which the air shaft opens into the interior insulative space, and a piece spaced apart from the second shoulder to create a clearance between the air shaft and the flexible insulative material;

wherein the twist valve comprises a substantially air and water tight seal when the cap is manually rotated relative to the body in a first rotational direction to a closed position where the at least one aperture is obstructed; and wherein the twist valve is configured to allow air flow into the interior insulative space to inflate the container and protect and insulate any article stored therein when the cap is manually rotated relative to the body in a second rotational direction to an open position where the at least one aperture is unobstructed.

6. The container of claim 5, further comprising:

at least one seam below the opening at the top end of the body portion, wherein the at least one seam is selected from the group consisting of: a single seam, a double seam, a triple seam, and any combination thereof.

7. The container of claim 6, wherein the at least one seam provides an increased carrying capacity of the container.

8. The container of claim 7, wherein the carrying capacity of the container is up to about 65 pounds.

9. The container of claim 6, further comprising:

at least one weld line below the at least one seam, wherein the weld line comprises a radio frequency weld that is substantially air and water tight.

10. The container of claim 5, wherein a waterproof base is sealed to the exterior shell at the bottom end of the body portion thereby enclosing the interior insulative space.

11. The container of claim 5, wherein the cap is secured to the body and wherein when the valve is in the open position, the cap remains secured to the body.

12. The container of claim 5, wherein the cap and the body of the valve each comprise threads, wherein the cap threads engage the body threads, and wherein the cap can be moved relative to the body pursuant to the threads.

13. The container of claim 5, wherein the valve comprises a plurality of apertures that allow air flow into and out of the insulative interior space.

14. The container of claim 5, wherein the piece spaced apart from the second shoulder comprises a disc piece.

15. A pliable, collapsible, inflatable, thermally insulative container, comprising:

a body portion having a top end, a bottom end, a flexible, waterproof interior liner, and a flexible, waterproof exterior shell, wherein the interior liner and the exterior shell are sealed together at the top end of the body portion forming an interior insulative space therebetween and a storage space that is lined by the interior liner and having an opening at the top end of the body portion;

a flexible insulative material disposed within the interior insulative space and being sealed therein;

a roll down quick release closure fixed to the body portion at the top end for closing the opening and the storage space;

at least one manually operated twist valve disposed through and secured to the exterior shell by way of a fluid impervious seal and configured to control air flow into and out of the interior insulative space between the interior liner and the exterior shell;

wherein the twist valve comprises a body and a cap, the cap comprising at least one aperture and configured to be manually rotatable relative to the body, the body comprising at least one air shaft, a first shoulder welded to the exterior shell, and a second shoulder within which the air shaft opens into the interior insulative space;

wherein the twist valve comprises a substantially air and water tight seal when the cap is manually rotated relative to the body in a first rotational direction to a closed position where the aperture is obstructed; and wherein the twist valve is configured to allow air flow into the interior insulative space to inflate the container and protect and insulate any article stored therein when the cap is manually rotated relative to the body in a second rotational direction to an open position where the at least one aperture is unobstructed.

16. The container of claim 15, wherein the carrying capacity of the container is up to about 65 pounds.

17. The container of claim 15, wherein a waterproof base is sealed to the exterior shell at the bottom end of the body portion thereby enclosing the interior insulative space.

18. The container of claim 15, wherein a waterproof base is sealed to the exterior shell at the bottom end of the body portion.

19. The container of claim 15, wherein the cap and the body of the valve each comprises threads, wherein the cap threads engage the body threads, and wherein the cap can be moved relative to the body pursuant to the threads.

20. The container of claim 15, wherein the valve comprises a plurality of apertures that allow air flow into and out of the insulative interior space.

* * * * *